US012139983B2

(12) United States Patent
Zahur et al.

(10) Patent No.: US 12,139,983 B2
(45) Date of Patent: Nov. 12, 2024

(54) NIPPLE-LESS WELL COMPLETION

(71) Applicant: Saudi Arabian Oil Company, Dhahran (SA)

(72) Inventors: Jawad Zahur, Abqaiq (SA); Bilal Tariq, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/888,875

(22) Filed: Aug. 16, 2022

(65) Prior Publication Data

US 2024/0060374 A1 Feb. 22, 2024

(51) Int. Cl.

| | |
|---|---|
| ***E21B 23/02*** | (2006.01) |
| ***E21B 17/02*** | (2006.01) |
| ***E21B 47/06*** | (2012.01) |

(52) U.S. Cl.
CPC ..... *E21B 23/02* (2013.01); *E21B 17/02* (2013.01); *E21B 47/06* (2013.01)

(58) Field of Classification Search
CPC ..... E21B 17/02; E21B 47/06; E21B 23/00; E21B 23/02; E21B 23/03
See application file for complete search history.

(56) References Cited

U.S. PATENT DOCUMENTS 4,406,324 A * 9/1983 Baugh ..... E21B 23/06 166/140
5,390,735 A * 2/1995 Williamson, Jr. ..... E21B 33/12 166/134
8,191,640 B2 * 6/2012 McCreedy ..... E21B 43/121 166/241.1
2011/0284238 A1 * 11/2011 Berry ..... E21B 23/02 166/369
2017/0226837 A1 * 8/2017 Kumar ..... E21B 34/14
2019/0390526 A1 * 12/2019 Durst ..... E21B 23/01
2022/0098944 A1 * 3/2022 Trisal ..... E21B 34/105

OTHER PUBLICATIONS

Gazda and Goiffon, "A Battery-Operated, Electro-Mechanical Setting Tool for Use with Bridge Plugs and Similar Wellbore Tools," OnePetro, OTC-7877-MS, Paper presented at the Offshore Technology Conference, Houston, Texas, May 1995, 14 pages.
Robison, "Monobore Completions for Slim-Hole Wells," J Pet Technol, SPE-29217-PA, 46 (09): 794-799, Sep. 1994, 6 pages.
Sherwani et al., "Introduction of Nippleless Tubing Stop Plug Application in Pakistan," OnePetro, SPE-163121-MS, Paper presented at the SPE/PAPG Annual Technical Conference, Islamabad, Pakistan, Dec. 2012, 10 pages.

* cited by examiner

*Primary Examiner* — Brad Harcourt
(74) *Attorney, Agent, or Firm* — Fish & Richardson P.C.

(57) ABSTRACT

A well completion includes a production tubing and a well tool. The production tubing includes an elongate cylindrical body including an inner diameter and having a length. The production tubing includes a completion profile formed at a location along the length of the body. An inner diameter of the completion profile is equal to an inner diameter of the body. The well tool is attached to the completion profile. The production tubing and the well tool are configured to perform a hydrocarbon production operation upon installation within a wellbore formed through a subterranean zone.

13 Claims, 4 Drawing Sheets

NIPPLE-LESS WELL COMPLETION

TECHNICAL FIELD

This disclosure relates to producing hydrocarbons through wells, and more particularly to well tools and well completion systems used to produce hydrocarbons through wells.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. After drilling, a production tubing and other well completions are installed within the wellbore to produce the hydrocarbons from the subsurface reservoir to the surface. Well completions include an assembly of well components and tools including tubing (or tubular) and other equipment (e.g., packers, flow sensors such as pressure gauges) that are used to optimize hydrocarbon production.

Well completions also include a nipple, which is a length of tubing with a machined internal surface that provides a locking profile. The machined internal surface and the locking profile allow hanging well completion components from the nipple.

SUMMARY

This specification describes technologies relating to a nipple-less well completion.

Certain aspects of the subject matter described here can be implemented as a well completion that includes a production tubing and a well tool. The production tubing includes an elongate cylindrical body including an inner diameter and having a length. The production tubing includes a completion profile formed at a location along the length of the body. An inner diameter of the completion profile is equal to an inner diameter of the body. The well tool is attached to the completion profile. The production tubing and the well tool are configured to perform a hydrocarbon production operation upon installation within a wellbore formed through a subterranean zone.

An aspect combinable with any other aspect includes the following features. The completion profile includes multiple carvings formed on an inner surface of the body. Each carving has a shape suitable for attachment to the well tool.

An aspect combinable with any other aspect includes the following features. The multiple carvings includes four carvings equidistantly formed along the inner surface of the body at the location.

An aspect combinable with any other aspect includes the following features. An outer diameter of the completion profile at the location is greater than an outer diameter of the body.

An aspect combinable with any other aspect includes the following features. The production tubing defines a wall thickness. The completion profile defines a wall thickness. The wall thickness of the completion profile is greater than the wall thickness of the production tubing at the location.

An aspect combinable with any other aspect includes the following features. The location is at a mid-point along the length of the production tubing.

An aspect combinable with any other aspect includes the following features. The location is at an end of the production tubing.

An aspect combinable with any other aspect includes the following features. The well completion includes a pup joint in which the completion profile is formed.

An aspect combinable with any other aspect includes the following features. The well completion includes a production string formed with the production tubing.

An aspect combinable with any other aspect includes the following features. The well completion includes a production packer. The hydrocarbon production operation includes isolating a portion of the wellbore downhole of the production packer from a portion of the wellbore uphole of the production packer.

An aspect combinable with any other aspect includes the following features. The well tool includes a pressure gauge configured to measure a pressure while performing the hydrocarbon production operation.

An aspect combinable with any other aspect includes the following features. The completion profile is a first completion profile. The location is a first location. The production tubing includes a second completion profile at a second location along the length of the body. An inner diameter of the second completion profile is equal to the inner diameter of the body. The second location is axially offset from the first location.

An aspect combinable with any other aspect includes the following features. The first location is nearer to an uphole end of the production tubing than a downhole end of the production tubing, and the second location is nearer to the downhole end of the production tubing than the uphole end of the production tubing.

Certain aspects of the subject matter described here can be implemented as a production tubing to produce hydrocarbons from a wellbore. The production tubing includes an elongate cylindrical body including an inner diameter and a length. The production tubing includes multiple slots formed at a location along the length of the body and equidistantly along an inner surface of the body at the location. A wall thickness of the location at which the multiple slots are formed is equal to a wall thickness of a remaining length of the body.

An aspect combinable with any other aspect includes the following features. The multiple slots is a first set of slots. The location is a first location. The production tubing includes a second set of slots formed at a second location along the length of the body and equidistantly along the inner surface of the body at the second location. A wall thickness of the second location is equal to the wall thickness of the remaining length of the body.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
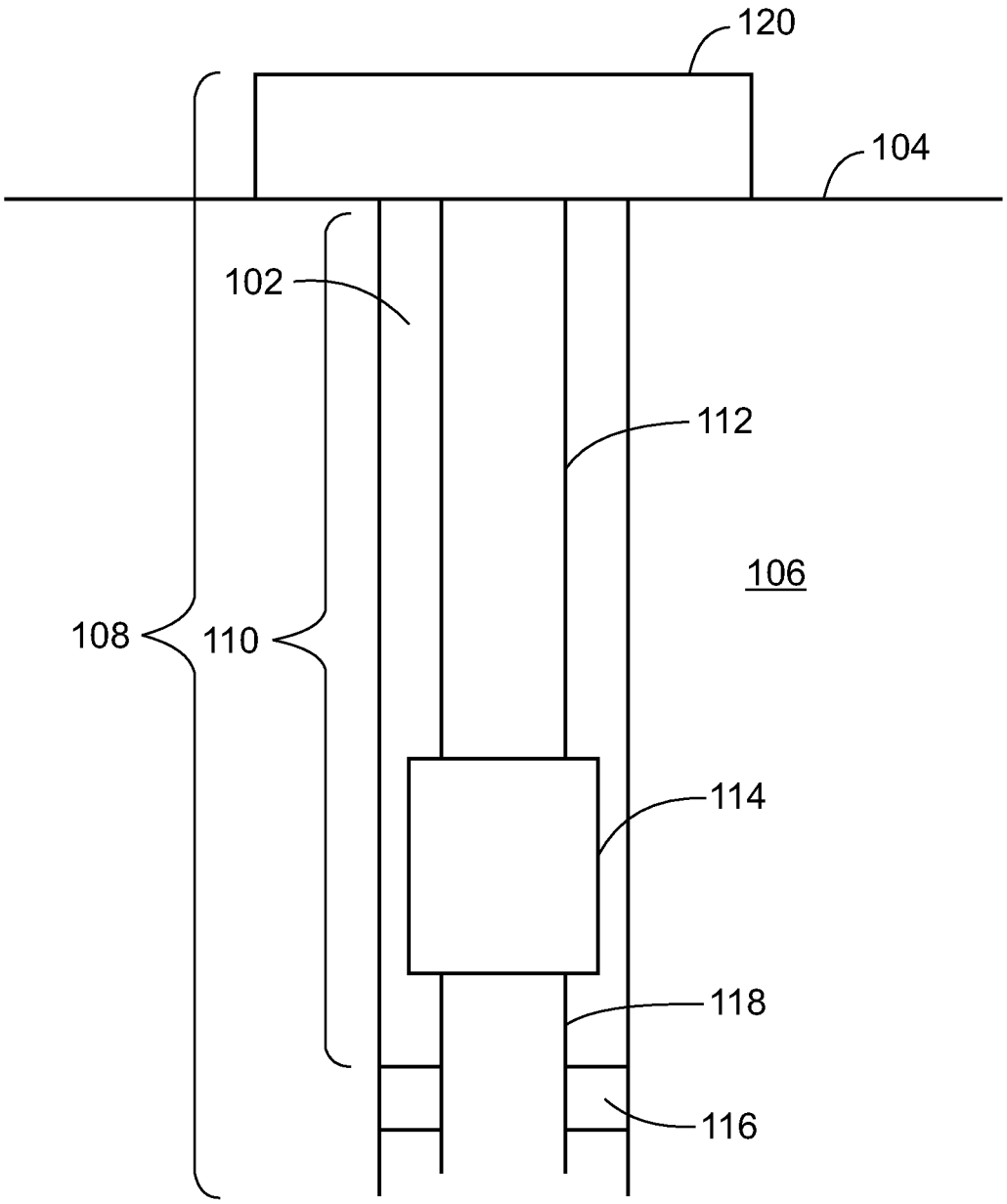
FIG. 1 is a schematic diagram of an example of a well completion.

A hydrocarbon (e.g., oil or gas or both) production well is completed with a production tubing string run on a production packer to isolate the production. That is, the production packer separates a downhole region of the well from an uphole region of the well, and also guides the hydrocarbons from the downhole region into the production tubing string. The production packer also isolates liners, casings and other well completion equipment from the produced hydrocarbons and associated water. The production tubing string has various accessories, each having its own functionalities. For example, a production string can include tubing with blank tubing pipe, nipple profiles, seal assemblies, packers, mule shoe guide and other well components. Depending on requirements, the production string can also include gas lift mandrels, permanent downhole gauges and a subsurface safety valve.

A production tubing string can also include a nipple having a profile used for a variety of purposes including, for example, hanging permanent or temporary pressure gauges to perform productivity index test in the hydrocarbon production well. In disposal or injector wells, a tubing string can have a nipple to perform an injectivity index test.

In some instances, a production string can have multiple nipples, one each on an upper portion and a lower portion of the production string. For example, the upper nipple is used to set a bridge plug as a barrier to isolate the lower portion. Subsequently, work can be done on well completion components uphole of the nipple, e.g., X-mas tree, wellhead, and the like. The lower nipple can be a no-go nipple that is used to hang permanent or temporary gauges or bridge plugs. Certain well intervention requirements may necessitate more than two nipples in the same production string.

Often, a nipple in a tubing string has the least inner diameter of the production string due to the presence of the machined internal surface and locking profile. For example, in a production string made up using tubings having an outer diameter of 4.5 inches (approximately 11.5 cm) and inner diameter of 3.92 inches (approximately 10 cm), a nipple can have an inner diameter of 2.625" inches (approximately 6.7 cm). An example of such a nipple is a no-go nipple that is used to hang or install well tools such as gauges or barrier plugs. The smaller inner diameter of the nipple limits well tool accessibility.

This disclosure describes a nipple-less well completion. The nipple-less well completion includes a length of tubing with a machined internal surface that has an enlarged grooved profile as part of the production tubing string. The enlarged groove profile is constructed such that an inner diameter of the nipple-less well completion is equal to an inner diameter of a remainder of the production tubing string. Under this construction, the smaller inner diameter region described earlier is eliminated. Even so, the profile of the nipple-less well completion allows hanging or setting well tools such as pressure gauges or plugs, while still providing through-bore access along an entire axial length of the production tubing.

Implementation of the subject matter described in this disclosure can allow tubings of larger outer diameter to be passed through the production string since the inner diameter of the nipple is equal to the inner diameter of other tubings that make up the production string. In addition, by eliminating the restricted area of the nipple, scale deposition due to the differential pressure, temperature or change in hydrocarbon fluid velocities can be minimized or eliminated. By eliminating such scale deposition or hydrate formation, accessibility to the well can be improved, thereby allowing easier implementation of well control issues such as well killing or plug setting. Furthermore, the absence of the restricted area of the nipple and the associated scale build-up reduces back pressure when pumping or injecting fluids into the well. The absence of the restricted area also reduces hindrance to the production fluids flowing to the surface, thereby increasing production rate. In addition, a smaller nipple size can limit the larger outer diameter (OD) tools to intervene in the well and in certain cases special small OD tools need to be made just in order to overcome the smaller well ID created due to this nipple profile. These intervention jobs are performed to remediate a number of issues with the well, such as, but not limited to, Production Logging, perforations, water shut off, milling, etc. The techniques described in this disclosure overcome such limitations.

FIG. 1 is a schematic diagram of an example of a well completion. FIG. 1 shows a schematic diagram of a well system 100. The well system 100 includes a wellbore 102 formed from a surface 104 of the earth through a subterranean zone 106 (e.g., a formation, a portion of a formation, multiple formations) to a subsurface reservoir (not shown) in which hydrocarbons entrapped. A well completion 108 is installed in the wellbore 102. The well completion 108 includes a production string 110. The production string 110 includes a production tubing 112 having an elongated cylindrical body having an inner diameter (FIGS. 2A, 2B) and a length. The production string 110 includes a completion profile 114 formed at a location along the length of the body of the production tubing 112. For example, the completion profile 114 is a short length of tubing (e.g., a pup joint) attached axially to an end of the production tubing 112. Alternatively or in addition, the completion profile 114 is an integral part of the production tubing 112 having a different construction than the production tubing 112, as described below. For example, the completion profile 114 is formed at a location (e.g., uphole end, downhole end, mid-point or other location) of the production tubing 112. An inner diameter of the completion profile 114 is equal to the inner diameter of the production tubing 112. Consequently, an entirety of the production string 110 has the same inner diameter.

The well completion 108 includes a well tool 116 attached to the completion profile 114. The production string 110 and the well tool 116 are configured to perform a hydrocarbon production operation upon installation within the wellbore 102. For example, the well tool 116 includes a production packer. The hydrocarbon production operation includes isolating a portion of the wellbore 102 downhole of the production packer from a portion of the wellbore 102 uphole of the production packer. The production string 110 and the production packer work together to produce the hydrocarbons from the subsurface reservoir to the surface 104 through the production string 110.

In some implementations, the well tool 116 can be a pressure gauge 118 that is configured to measure a pressure while performing the hydrocarbon production operation. For example, the pressure gauge 118 can hang from the completion profile 114. The pressure gauge 118 can measure, for example, a pressure of the hydrocarbons flowing through the production string 110 to the surface 104. In place of or in addition to the pressure gauge 118, other sensors, for example, a flowmeter, a temperature sensor, or sensors that can measure parameters of the flowing hydrocarbons can hang from the completion profile 114. In some implementations, the production packer and the pressure gauge can be deployed in the same well completion 108.

Figure 2A:
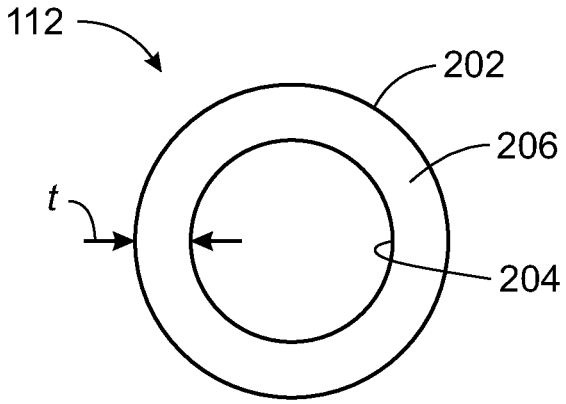
FIGS. 2A and 2B are schematic diagrams of cross-sectional views of the well completion of FIG. 1.
Figure 2B:
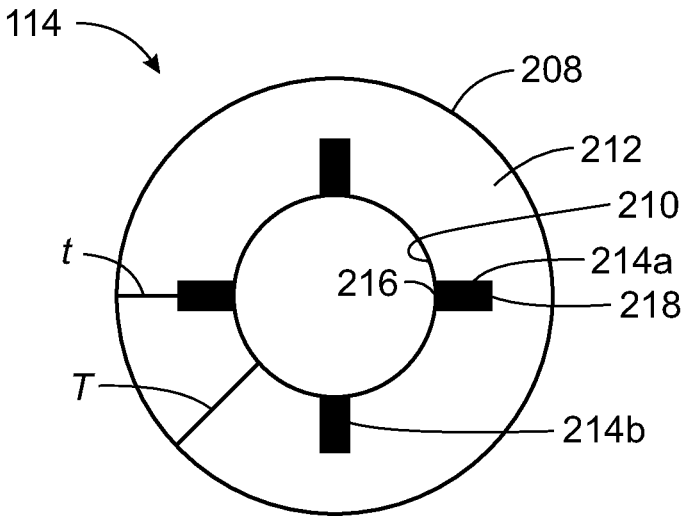

FIGS. 2A and 2B are schematic diagrams of cross-sectional views of the well completion of FIG. 1. FIG. 2A is a schematic diagram of the production tubing 112, and FIG. 2B is a schematic diagram of the completion profile 114. As shown in FIG. 2A, the production tubing 112 has an outer surface 202, an inner surface 204 and a wall 206 between the outer surface 202 and the inner surface 204. The wall 206 of the production tubing 112 has a thickness (schematically shown as "t"). As shown in FIG. 2B, the completion profile 114 has an outer surface 208, an inner surface 210 and a wall between the outer surface 208 and the inner surface 210. The wall 212 of the completion profile 114 has a thickness (schematically shown as "T"). The thickness of the wall 212 of the completion profile 114 is greater than the thickness of the wall 206 of the production tubing 112. The inner diameter of the production tubing 112 is equal to the inner diameter of the completion profile 114.

The completion profile 114 includes one or more carvings (e.g., a first carving 214*a*, a second carving 214*b*, or more or fewer carvings). For example, four carvings can be formed on the inner surface 210 of the completion profile and can be positioned equidistantly from each other along the inner surface 210. That is, each carving is offset from an adjacent carving by 90°. The number of carvings formed on the completion profile 114 can be chosen based on the type of well tool 116 or other well completion equipment to be hung from or otherwise coupled to the completion profile 114.

In implementations in which the completion profile 114 is a separate component axially attached to an end of the production tubing 112, each carving is formed on the inner surface 210 of the completion profile 114. In implementations in which the completion profile 114 is an integral part of the production tubing 112, each carving is formed on the inner surface 204 of the production tubing 112. Each carving has a shape suitable for attachment to the well tool 116. For example, each carving can be formed as a slot that is machined from the inner surface 210 of the completion profile 114 radially towards the outer surface 208 of the completion profile 114 in the wall 212 of the completion profile 114. After machining, each slot (or carving) has one end (e.g., end 216 of carving 214*a*) that aligns with the inner surface 210 of the completion profile 114, and another end (e.g., end 218 of carving 214*a*) that defines an inner edge of the wall 212 from which material has been machined to define the carving. The depth to which each carving is machined is selected such that a distance from the end 218 of carving 214*a* to the outer surface 208 is equal to the thickness ("t") of the wall 206 of the production tubing 112.

By forming each carving to the depth as described here, a minimum thickness of the wall of the production string 110 that includes the production tubing 112 and the completion profile 114 is kept the same. Consequently, a structural integrity of the production string along an entire length of the production string 110 is maintained. In addition, by maintaining the inner diameter of the production tubing 112 to be equal to the inner diameter of the completion profile 114, smaller diameter restrictions that are found in some nipple profiles are eliminated. The result is a nipple-less profile, as described in this disclosure. The completion profile 114 constructed as described in this disclosure is similar to a blast joint with a larger outer diameter. As described earlier, the larger outer diameter of the completion profile 114, as compared to that of the production tubing 112, ensures that a wall thickness after forming the carvings in the completion profile 114 remains equal to a wall thickness of the production tubing 112 that is axially coupled to the completion profile 114.

Figure 3A:
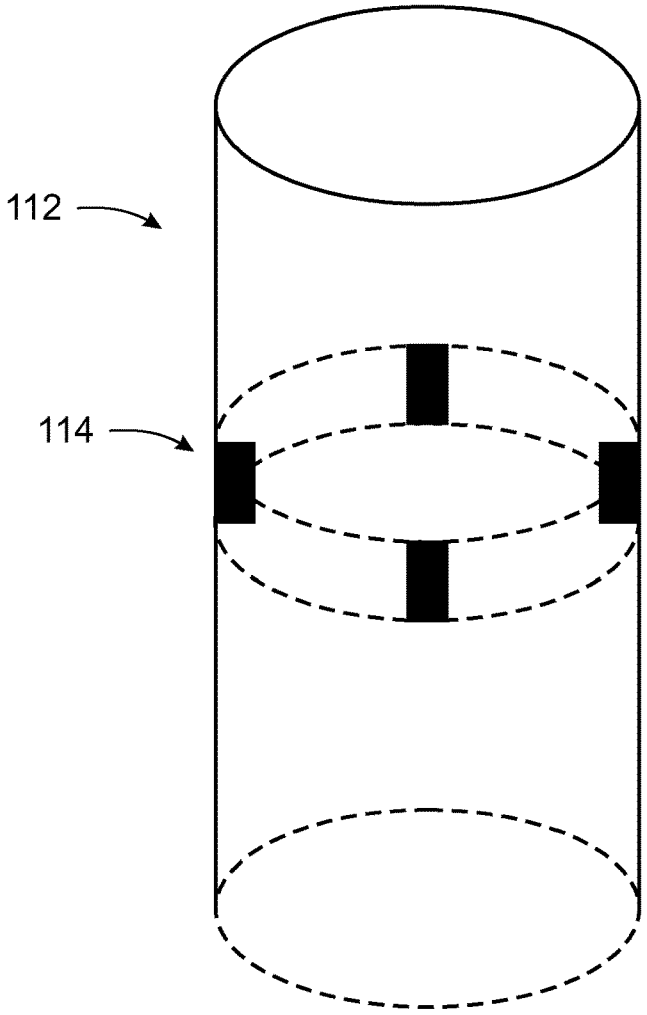
FIGS. 3A and 3B are schematic diagrams of views of the well completion of FIG. 1.
Figure 3B:
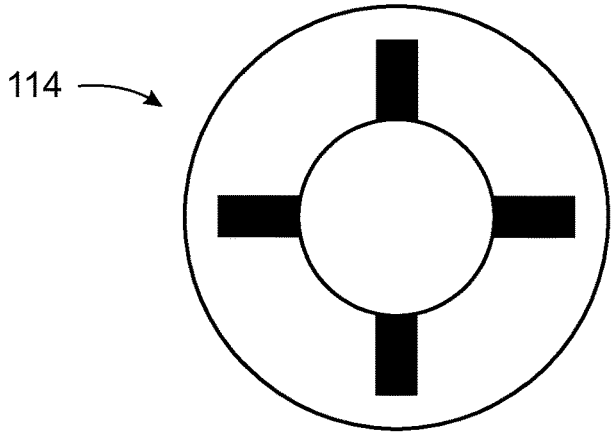

FIGS. 3A and 3B are schematic diagrams of views of the well completion of FIG. 1. FIG. 3A shows a front view of the production string 110 with the completion profile 114. In implementations in which the completion profile 114 is an integral part of the production tubing 112, the completion profile 114 can be machined at any location along the length of the production tubing 112. For example, as shown in FIG. 3A, the completion profile 114 is machined near the mid-point along the length of the production tubing 112. Alternatively, and based on the application, the completion profile 114 can be machined at a different location along the length of the production tubing 112. FIG. 3B shows a top view of the completion profile 114 machined at near the mid-point along the length of the production tubing 112.

Figure 4:
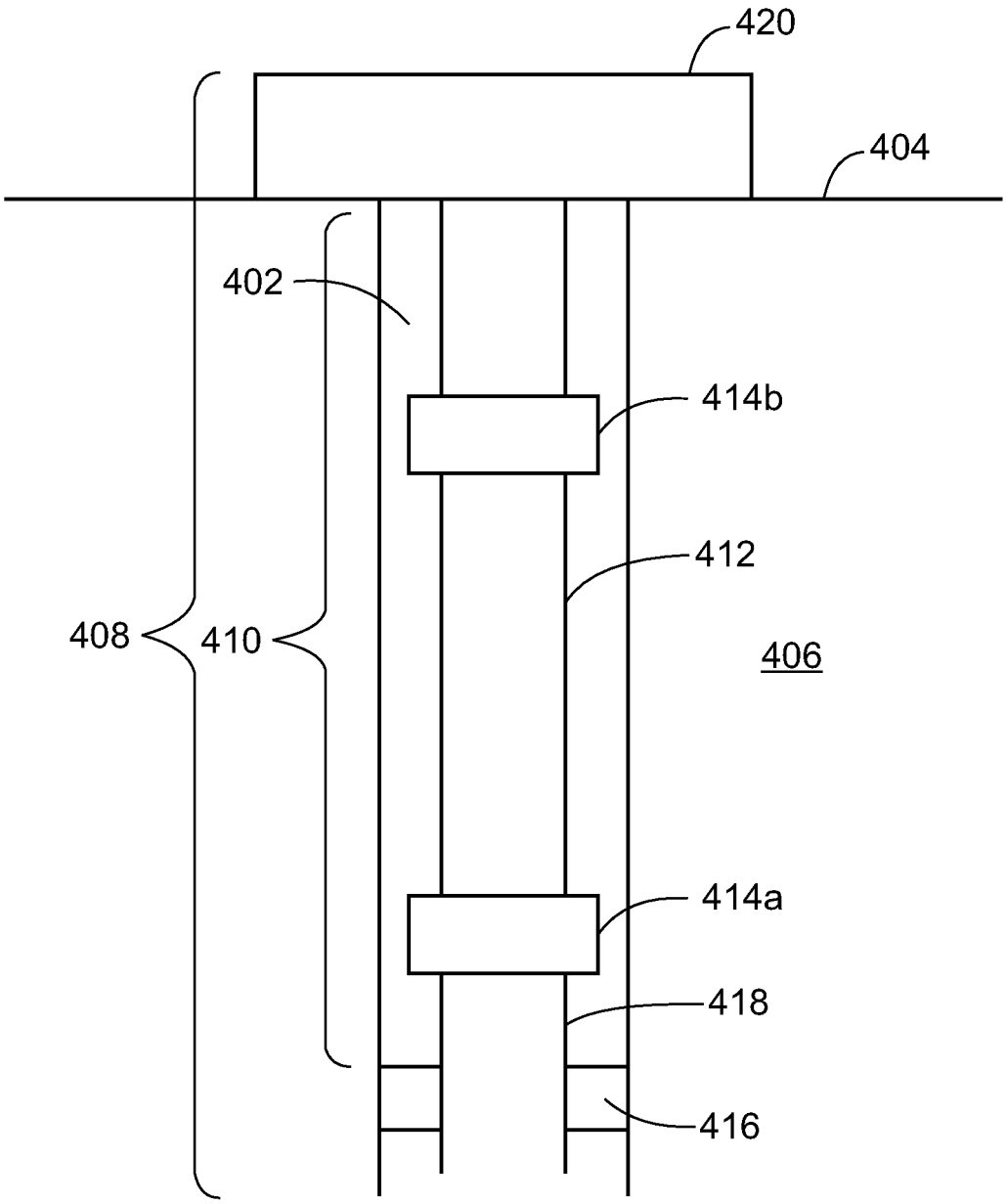
FIG. 4 is a schematic diagram of an example of another well completion.

FIG. 4 is a schematic diagram of an example of another well completion 400 substantially similar to the well completion 100 (FIG. 1), except that the way completion 400 has two completion profiles 414*a* and 414*b*. The well system 400 shown in FIG. 4 includes a wellbore 402 formed from a surface 404 of the earth through a subterranean zone 406 (e.g., a formation, a portion of a formation, multiple formations) to a subsurface reservoir (not shown) in which hydrocarbons entrapped. A well completion 408 is installed in the wellbore 402. The well completion 408 includes a production string 410. The production string 410 includes a production tubing 412 substantially similar to the production tubing 112 (FIG. 1). The production string 410 includes two completion profiles 414*a* and 414*b*, each formed at axially offset locations (e.g., an uphole end and a downhole end) along the length of the body of the production tubing 412. For example, each of the completion profile 414*a* and 414*b* is a short length of tubing (e.g., a pup joint) attached axially to respective ends of the production tubing 412. Alternatively or in addition, each of the completion profiles 414*a* and 414*b* is an integral part of the production tubing 412 having a different construction than the production tubing 412, similar to construction of the production tubing 112 (FIG. 1) and the completion profile 114 (FIG. 1). An inner diameter of each of the completion profiles 414*a* and 414*b* is equal to the inner diameter of the production tubing 412. Consequently, an entirety of the production string 410 has the same inner diameter. Carvings or slots are machined in each of the completion profiles 414*a* and 414*b*, similar to carvings or slots machined in the completion profile 114 (FIG. 1).

Thus, particular implementations of the subject matter have been described. Other implementations are within the scope of the following claims.

The invention claimed is:

1. A well completion comprising:

a production tubing comprising:

an elongate cylindrical body comprising an inner diameter and having a length, and a completion profile formed at a location along the length of the body, wherein an inner diameter of the completion profile is equal to the inner diameter of the body; and a well tool attached to the completion profile, the production tubing and the well tool configured to perform a hydrocarbon production operation upon installation within a wellbore formed through a subterranean zone, wherein the completion profile is a first completion profile, wherein the location is a first location, wherein the production tubing comprises a second completion profile at a second location along the length of the body, wherein an inner diameter of the second completion profile is equal to the inner diameter of the body, wherein the second location is axially offset from the first location.

2. The well completion of claim 1, wherein the completion profile comprises a plurality of carvings formed on an inner surface of the body, each carving having a shape suitable for attachment to the well tool.

3. The well completion of claim 2, wherein the plurality of carvings comprises four carvings equidistantly formed along the inner surface of the body at the location.

4. The well completion of claim 2, wherein an outer diameter of the completion profile at the location is greater than an outer diameter of the body.

5. The well completion of claim 4, wherein the production tubing defines a wall thickness, wherein the completion profile defines a wall thickness, wherein the wall thickness of the completion profile is greater than the wall thickness of the production tubing at the location.

6. The well completion of claim 4, wherein the location is at a mid-point along the length of the production tubing.

7. The well completion of claim 4, wherein the location is at an end of the production tubing.

8. The well completion of claim 2, further comprising a pup joint in which the completion profile is formed.

9. The well completion of claim 1, further comprising a production string formed with the production tubing.

10. The well completion of claim 1, further comprising a production packer, wherein the hydrocarbon production operation comprises isolating a portion of the wellbore downhole of the production packer from a portion of the wellbore uphole of the production packer.

11. The well completion of claim 1, wherein the well tool comprises a pressure gauge configured to measure a pressure while performing the hydrocarbon production operation.

12. The well completion of claim 1, wherein the first location is nearer to an uphole end of the production tubing, and the second location is nearer to a downhole end of the production tubing.

13. A production tubing to produce hydrocarbons from a wellbore, the production tubing comprising:

an elongate cylindrical body comprising an inner diameter and having a length; and a plurality of slots formed at a location along the length of the body and equidistantly along an inner surface of the body at the location, wherein a wall thickness of the location at which the plurality of slots are formed is equal to a wall thickness of a remaining length of the body, wherein the plurality of slots is a first plurality of slots, wherein the location is a first location, wherein the production tubing comprises a second plurality of slots formed at a second location along the length of the body and equidistantly along the inner surface of the body at the second location, wherein a wall thickness of the second location is equal to the wall thickness of the remaining length of the body.

* * * * *